United States Patent [19]

Nergard

[11] 4,099,642

[45] Jul. 11, 1978

[54] DRINKING RECEPTACLE COVER AND VALVE ASSEMBLY

[75] Inventor: Orv Nergard, Fridley, Minn.

[73] Assignee: Dart Industries, Inc., Los Angeles, Calif.

[21] Appl. No.: 856,390

[22] Filed: Dec. 1, 1977

[51] Int. Cl.[2] ..... A47G 19/22

[52] U.S. Cl. ..... 220/90.4; 220/254; 220/337; 220/293; 220/295; 222/511; 222/518; 222/515

[58] Field of Search ..... 220/90.4, 9 R, 17, 254, 220/378, 348, 337, 203, 361, 293, 295; 222/566–573, 511, 518, 544, 575, 563, 508, 509, 542, 487, 481.5; 215/315, 356, 329, 307; 251/251

[56] References Cited

U.S. PATENT DOCUMENTS

| | | | |
|---|---|---|---|
| 3,240,373 | 3/1966 | Dulle | 215/215 |
| 3,964,631 | 6/1976 | Albert | 222/518 X |
| 3,967,748 | 7/1976 | Albert | 220/90.4 |
| 3,972,443 | 8/1976 | Albert | 220/90.4 |

*Primary Examiner*—George T. Hall

*Attorney, Agent, or Firm*—Kenneth J. Hovet

[57] ABSTRACT

A cup shaped cover and valve assembly is provided for a drinking receptacle to close off the open top of the receptacle to prevent spilling or splashing of either hot or cold beverages in the receptacle. The cover includes a plate surrounded by a rim, the plate being slightly tilted in the rim so that its top surface slopes between diametrically opposite points on the rim. An elongated opening is provided in the plate adjacent to its lowest level portion and a valve head in turn positioned beneath the plate to close the opening. The valve head is biased against the opening by resilient integral supporting arms secured to the bottom of the plate. The assembly is completed by an actuating member passing into one side of the rim diametrically opposite the beverage opening in the plate, this actuating member passing beneath the plate and terminating in a camming surface such that inward movement of the member cams the valve head away from the bottom of the plate to open the opening and permit drinking of the beverage. Releasing of the member permits the resilient supporting arms for the valve head to close off the opening.

10 Claims, 8 Drawing Figures

FIG. 1
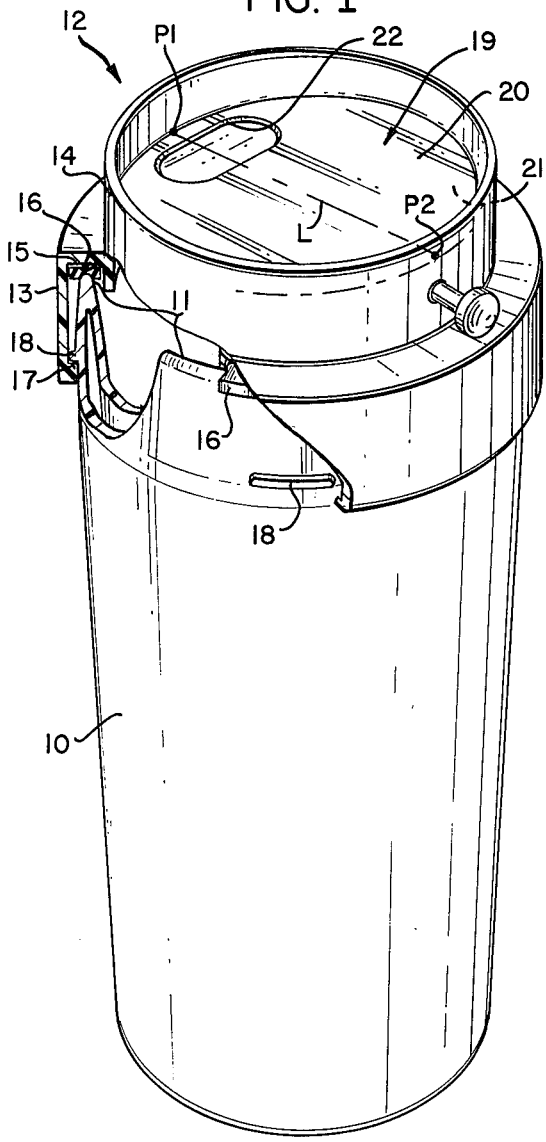
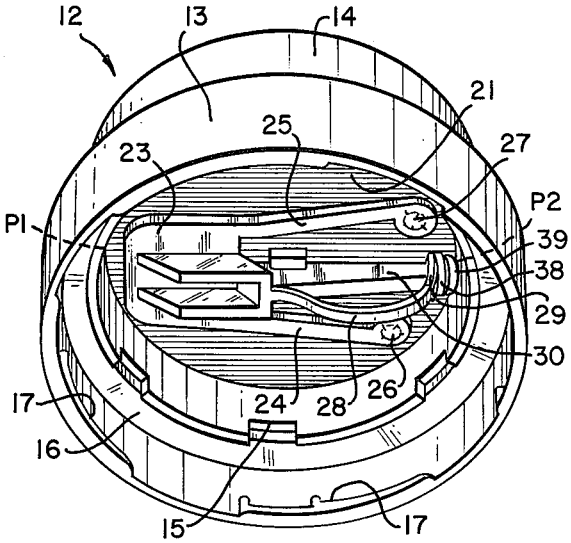
FIG.2
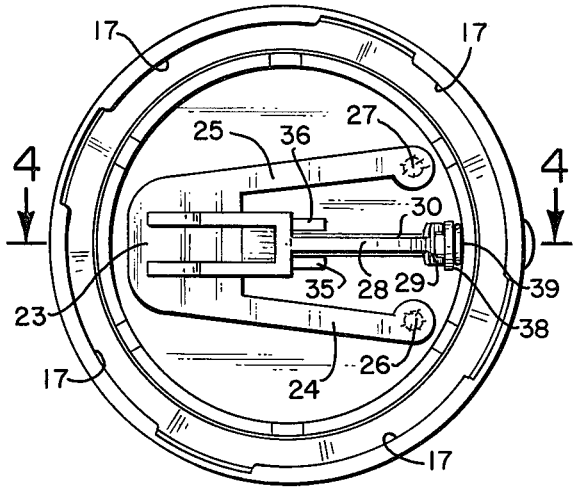
FIG.3
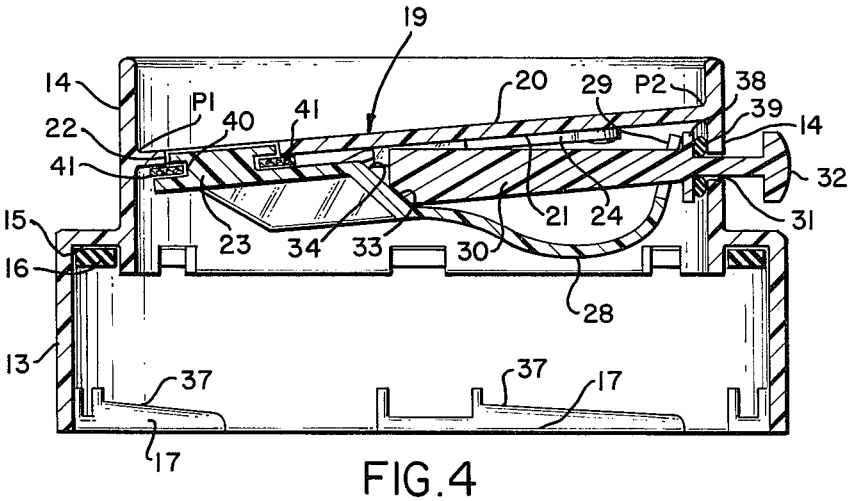
FIG.4

DRINKING RECEPTACLE COVER AND VALVE ASSEMBLY

BACKGROUND OF THE INVENTION

1. Field of the Invention

This invention relates generally to drinking receptacles and, more particularly, to an improved cover and valve assembly for covering the open top of a drinking receptacle wherein a beverage drinking opening in the cover can be manually opened or closed by an appropriate actuating member extending from a side of the cover.

2. Description of the Prior Art

Drinking receptacles with covers incorporating manually operable valve means are known in the art. These receptacles are generally used for holding beverages by persons when boating, hiking, travelling to and from work in a vehicle, or in any similar situation wherein the receptacle is subject to motion. The cover and valve assemblies are designed to essentially seal off the open top of the receptacle and prevent spillage and the like. When it is desired to drink from the receptacle, the valve mechanism is normally operated by depressing a valve stem extending from the side of the cover with a person's finger. This opens a beverage outlet on a diametrically opposite portion of the cover from which the person can drink. Release of the valve stem or actuating member results in the opening being automatically closed.

One problem associated with certain presently available drinking receptacles of the foregoing type is the relatively large number of component parts required for the valve assembly in the cover. Generally, a simple poppet type valve head is provided beneath a beverage outlet opening provided in the cover which valve head is biased against the bottom opening to close off this opening. The poppet valve and opening are of a circular configuration and there is normally provided an inner coupling arrangement between the valve stem or actuating member extending from the side of the cover for moving the poppet valve head away from the opening to permit beverages to pass therethrough. In many of the presently available designs, metal springs and screws and the like have been used in the valve assembly. The use of any type of metal is generally undesirable not only from a sanitary standpoint but also because of ultimate corrosion of these metal parts.

Further problems exist with presently available designs in the cover structure itself. Generally, these covers include a flat plate surrounded by an annular rim the beverage outlet opening being disposed adjacent one edge of the rim and the valve actuating member extending from the opposite end for easy operation by a person's finger. However, there can be a tendency for some liquid to accumulate on the top surface of the plate after a person has been drinking from the receptacle with the result that subsequent motion could cause this accumulated liquid to spill over the rim. In order to avoid this problem, small ridges or ribs have been provided on the top surface of the plate on either side of the beverage outlet opening to help confine the flow of beverage from the receptacle into a person's mouth. In addition, it is important that any poppet type valve seat accurately on the underside of the beverage opening in the cover to avoid inadvertent leaks when the receptacle is not being used. In other words, unless appropriate design is provided for the biasing arrangement to close the poppet valve, possible canting or tilting of the valve could occur, or, in the event the biasing arrangement utilized to exert a closing force becomes worn complete closure cannot be assured.

An example of a prior art drinking receptacle with a cover and valve assembly is U.S. Pat. No. 3,964,631 issued June 22, 1976. Among the disadvantages of this device is the use of a depending finger against a resilient arm for biasing a poppet valve against an opening. Whenever the finger overrides the arm, the valve will become locked in an open position.

BRIEF DESCRIPTION OF THE PRESENT INVENTION

With the foregoing in mind, the present invention contemplates an improved drinking receptacle cover and valve assembly overcoming many of the difficulties heretofore mentioned with respect to the prior art.

More particularly, the cover and valve assembly of this invention avoids the use of any metal springs or other metal parts, is easy to clean, provides an unrestricted even flow of fluid from the beverage dispensing opening in the cover, minimizes the tendency for any beverage to accumulate on the top surface of the cover and provides uniquely designed valve head and biasing arrangements to assure accurate and proper seating of the valve to properly seal off the beverage opening when a person is not drinking from the receptacle.

Briefly, these and other features and advantages of this invention are obtained by providing a cover and valve assembly for covering the open top of a drinking receptacle including a plate having top and bottom surfaces with an annular rim surrounding the plate. The plate is slightly tilted in the rim so that its top surface slopes upwardly from a first point on the rim to a second diametrically opposite point. The plate has a beverage outlet opening adjacent to the first point which is elongated in a direction at right angles to a diametric line between the first and second points. This elongated opening more nearly conforms to a person's mouth covering the opening when drinking from the receptacle.

A valve head is provided beneath the opening in the plate with a pair of resilient arm supports to assure even biasing force on the valve head. These resilient arms are secured to the bottom surface of the plate and bias the valve head upwardly against the bottom periphery of the opening to normally hold the opening closed. An actuating member passes through a side opening in the rim beneath the surface of the plate to engage the valve head in a camming action such that when the member is urged inwardly by a person's finger, the valve head is moved away from the opening so that a person can drink a beverage from any receptacle over which the cover has been secured. The actuating member itself passes loosely through the side opening of the rim so that when it is depressed inwardly, air can enter around the member into the container and replace beverage passing out the beverage opening thereby assuring a smooth and uninterrupted flow.

BRIEF DESCRIPTION OF THE DRAWINGS

A better understanding of this invention will be had by now referring to the accompanying drawings in which:

FIG. 1 is a perspective view of the drinking receptacle and cover partly cut away to illustrate details of the attachment of the cover to the receptacle;

FIG. 2 is an underside perspective view of the cover separated from the container;

FIG. 3 is an underside plan view of the cover of FIG. 2;

FIG. 4 is a cross section of the cover taken in the direction of the arrows 4—4 of FIG. 3 showing the valve portion of the cover in closed position;

DETAILED DESCRIPTION OF THE PREFERRED EMBODIMENT

Figure 5:
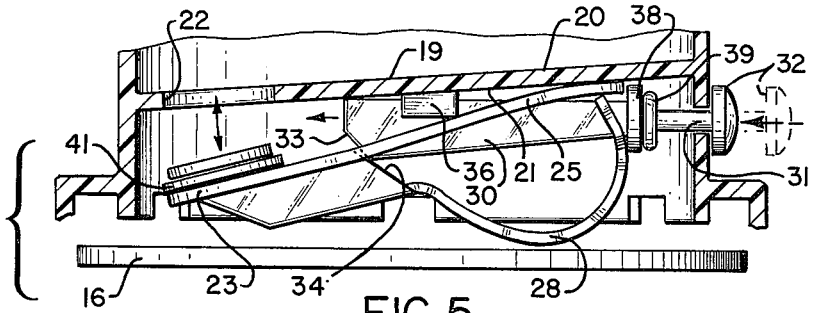
FIG. 5 is a fragmentary cross section similar to FIG. 4 with certain portions shown in full lines illustrating the position of parts when the valve is open and further illustrating a sealing gasket in exploded relationship.

Referring first to FIG. 1, a drinking receptacle preferably of the double wall type is shown at 10 for receiving either hot or cold beverages. Receptacle 10 includes an open top 11 arranged to be closed by a cover and valve assembly indicated generally by the numeral 12.

As will be clear from both FIGS. 1 and 2, the cover and valve assembly 12 is generally cup-shaped for closing off the open top 11 of the receptacle and includes a lower annular wall portion 13 dimensioned to surround the upper exterior portion of the open top. An upper annular wall portion 14 constituting a rim is of reduced diameter and formed integrally with the lower annular wall 13 to define an internal downwardly facing annular step 15, for seating on the periphery of the open top 11 as shown. In the particular embodiment illustrated, a thin annular sealing gasket 16 is provided on the step 15 for actually engaging the upper periphery of the top opening of the receptacle.

As best illustrated in the broken-away portion of FIG. 1, an interior portion of the lower annular wall 13 and exterior portion of the open top have integrally formed inter-engaging means for removably securing the cover to the receptacle. In the specific embodiment disclosed, these inter-engaging means take the form of a plurality of lip segments 17 circumferentially spaced about the bottom of the lower annular wall 13 as best shown in FIG. 2 and extending radially inwardly short distances to define ledges, the exterior portion of the open top of the receptacle including a like plurality of circumferentially spaced radially outwardly extending ridges 18 receivable between the lips such that when the cover is rotated through the circumferential extent of the lips, the ridges overlie the ledges to lock the cover to the receptacle.

Referring to the top portion of FIG. 1, the cover 12 further includes a flat plate 19 surrounded and integrally formed with the rim 14. Plate 19 is inclined slightly from the horizontal and has top and bottom surfaces 20 and 21 such that the top surface 20 slopes upwardly relative to the rim 14 between a first point designated P1 and a second diametrically opposite point P2 of the rim. A beverage outlet opening 22 in turn is provided adjacent to the first point P1 and is purposely elongated in a direction at right angles to a diametric line L extending between the first and second points.

Referring now specifically to the underside of the cover as illustrated in FIG. 2, there is provided a valve head 23 positioned beneath the bottom surface 21 of the plate and dimensioned to close the opening 22 of FIG. 1 when moved upwardly against the bottom surface. This valve head has first and second integrally formed resilient arms 24 and 25 extending from opposite side portions thereof in slightly divergent directions along the bottom surface 21 of the plate. The arms 24 and 25 terminate at securement points 26 and 27, respectively, on the bottom surface adjacent to and on either side of the second point P2 of the rim. The arrangement is such that the valve head is evenly held and biased by the resilient arms on each side against the bottom surface of the plate to close off the elongated opening 22 of FIG. 1.

The underside of the valve head 23 further includes an integrally formed resilient strip 28 extending in a direction below and in a plane between the first and second arms 24 and 25 towards the second point P2 of the rim to terminate in a fork structure 29. It will be noted that this elongated strip is biased into a convexly curved shape when viewed from the bottom.

The valve assembly of FIG. 2 is completed by the provision of a manually operable actuating member 30 extending through the rim in a loose fit at the second point P2 adjacent to the bottom surface 21 of the plate. It will be noted that actuating member 30 is provided with a fixed collar 38 which is engaged by the fork portion 29 of the curved strip 28. In this manner, the actuating member is biased against collar 38 to move the actuating member outwardly or to the right as viewed in FIGS. 2 and 3 by the tendency of resilient strip 28 to straighten from its curved configuration.

With specific reference now to the cross-section of FIG. 4, wherein like elements have been identified by the same numerals used in FIGS. 1–3, the loose fit of the actuating member 30 to the rim 14 is depicted adjacent the portion 31 of the actuating member extending outside the rim. Beyond portion 31 the actuating member terminates in a manually operable push-button 32.

The inner end of the actuating member terminates in a camming surface 33. The underside of the valve head 23 in turn defines a cooperating camming surface 34 which is adapted to slidingly engage the surface 33. In this manner inward movement of the member 30, which movement is to the left as viewed in FIG. 4, cams the valve head 23 downwardly to flex portions of the first and second arms 24 and 25 away from the plate bottom surface 21 to thereby open the beverage outlet opening 22.

FIG. 5 illustrates the position of the various parts when the actuating member has been moved inwardly to swing valve head 23 away from opening 22.

To assure proper registration of the camming surface 33 on the camming surface 34 and thus assure an even application of camming force for proper movement of the valve head 23, guide blocks are provided integrally formed on the bottom side 21 of the cover plate 19. The blocks are spaced-apart a distance slightly greater than the width of the actuating member. With the member 30 therebetween, the blocks will guide the inward and outward movement of member 30 so as to centrally engage the camming surface 34 of the valve head 23. The guide blocks are best illustrated in the underside plan view of FIG. 3.

Referring again to both FIGS. 4 and 5, additional features of the described structure will become evident.

Thus, referring to the lower portion of FIG. 4, there is illustrated in full lines some of the lips 17 described in conjunction with FIG. 1 wherein it will be noted that the upper surface of the inwardly turned portion defining the referred to ledges slope slightly as indicated at 37 to thereby cam the cover tightly down onto the top of the receptacle 10 when it is locked to the ridges 18 described in FIG. 1.

As shown in both FIGS. 4 and 5, the actuating member 30 is provided with the aforementioned fixed collar 38 at the point it emerges from the rim 14 into the interior of the cover. It thereby provides an engaging surface for the fork structure 29 at the end of the resilient strip 28. In addition, this fixed collar serves to sandwich a sealing washer 39 against the inside wall portion of the rim through which the actuating member extends. In this manner the loose fitting portion 31 of area around the actuating member 30 will be sealed when the actuating member is in its outermost position as shown in FIG. 4. It will be evident that when the actuating member 30 is urged inwardly to the position illustrated in FIG. 5, the loose fit permits air to enter the cover and the receptacle thus replacing beverage passing out the opening 22 so that a smooth flow of the beverage is assured.

The slanting of the cover plate 19 between the diametrically opposite points P1 and P2 of the rim 14 is clearly shown in FIGS. 4 and 5 and it will be evident that when the receptacle is level, this slanting arrangement will cause any beverage spilled on the top surface 20 of the plate 19 to gravitate towards the opening 22.

Figure 6:
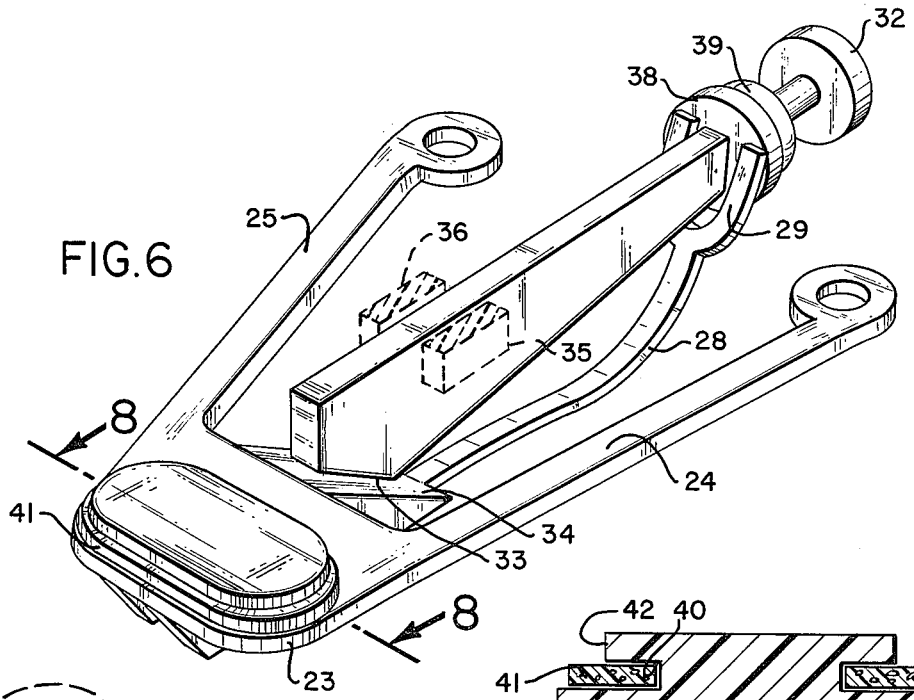
FIG. 6 is an enlarged perspective view of the valve head and supporting structure with cooperating actuating member separated from the remaining portions of the cover.
Figure 7:
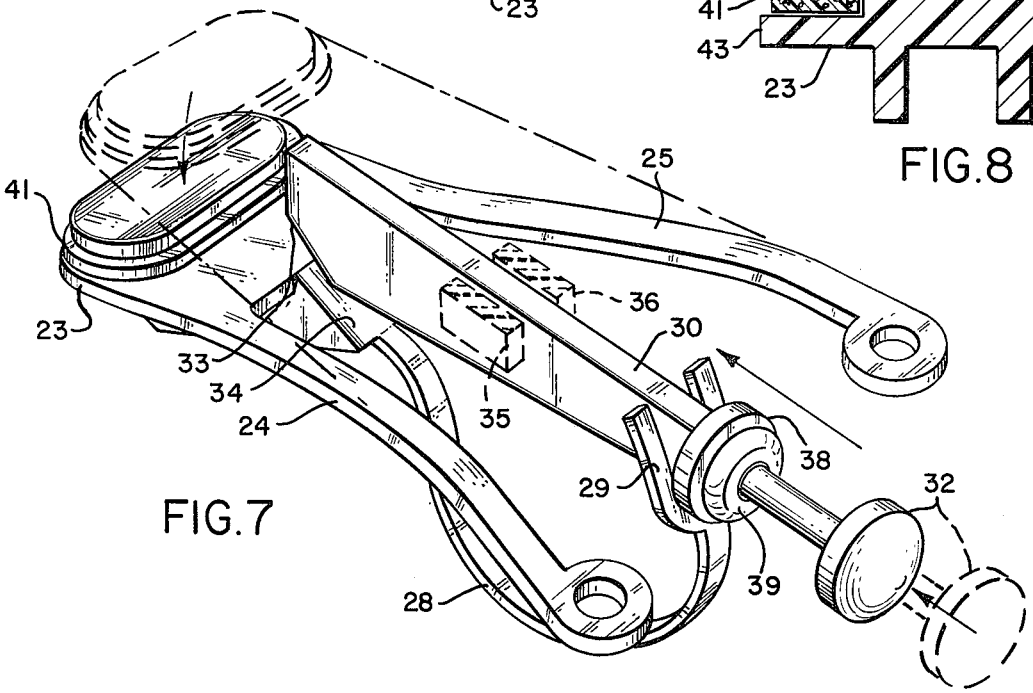
FIG. 7 is another perspective view similar to FIG. 6 taken from a different direction; and, FIG. 8 is a detailed cross section of the valve head taken in the direction of the arrows 8—8 of FIG. 6.

FIGS. 6 and 7 illustrate in enlarged perspective views the various components previously identified. In these views, the guide blocks 35 and 36 are depicted in phantom lines since these blocks are normally integrally formed on the bottom surface 21 of plate 19.

It will be noted in both FIGS. 6 and 7 that the valve head 23 includes a shaped portion elongated to correspond to that of the elongated opening 22 illustrated in FIG. 1. The positioning of the resilient arms 24 and 25 from opposite sides of the valve head 23, as also mentioned heretofore, will assure proper resilient biasing force to both of the extreme end portions of the elongated valve head so that the risk of any inadvertent canting or tilting as might take place were only a single resilient centrally disposed support provided, is avoided.

Figure 8:
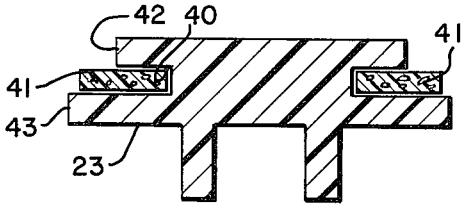

FIG. 8 shows a detail of the valve head structure 23 utilized in closing off the opening and it will be noted that this valve head is provided with a lateral groove 40 extending about its peripheral edge. A sealing gasket 41 is provided in this groove as illustrated. The upper wall of the groove has a perimeter 42 less than the perimeter of the elongated opening 22 of FIG. 1 while the perimeter of the lower wall shown at 43 of the groove as well as the perimeter of the gasket 41 is greater than the perimeter of the opening. With this arrangement, the upper wall 42 is received within the opening, the sealing gasket 41 being sandwiched against the bottom periphery of the opening and the lower wall of the groove to thereby seal the opening when the actuating member is released so that the resilient arms hold the valve head 23 with gasket 41 against the bottom of the plate 19 to cover the opening 22.

OPERATION

The operation of this invention will be evident from the foregoing description. In its broadest aspect, the cover and valve assembly designated generally by the numeral 12 in FIG. 1 could be applied to the top of any drinking receptacle provided the lower annular wall 13 is of proper internal diameter to afford a frictional engagement with the open top of such receptacle. However, in the particular embodiment disclosed in the drawings, the beverage receptacle itself is specifically designed to cooperate with the cover by the provision of the ridges 18 and the lip portions on the lower end of the annular wall 13 of the cover, all as described heretofore. In either event, the beverage receptacle can be filled with either a hot or cold beverage and the cover 12 easily inserted in place. The resilient arms 24 and 25 as well as the resilient strip 28 described in FIGS. 2 and 3 will hold the valve head 23 against the bottom of the opening 22 so that the contents of the receptacle are properly sealed. In this respect, it will be appreciated that the loose fit portion 31 described in FIG. 4 where the actuating member 30 enters the rim 14 is also closed off by the sealing washer 39.

When a person desires to drink from the receptacle, he simply depresses the actuating member 30 by engaging the button portion 32 with his finger and urging the same inwardly to swing valve 23 away from the opening 22. The elongated configuration of this opening conforms relatively closely to the person's mouth which will cover the rim at the point P1 and a portion of the top surface of the plate as the receptacle is tilted upwardly to drink. Further, with the actuating member urged inwardly, the loose fit of the member through the rim permits air to enter the receptacle through the cover to replace the beverage passing out the opening 22 all as also described heretofore.

Finally, should any of the beverage leak onto top surface 20 while drinking from the top opening 22, such will gravitate towards the opening 22 due to the slanted plate when the receptacle is placed on a table or leveled. Thus, a person need only depress the actuating member to open the opening 22 momentarily and permit draining of this excess beverage back into the container.

The various seals and preferred double walled container construction will assist in helping to maintain the beverage in an insulated condition. All of the parts may be extruded or injection molded from plastic so that metal parts such as springs or screws and the like are not required.

From all of the foregoing, it will thus be evident that the present invention has provided a vastly improved drinking receptacle cover and valve assembly wherein various problems and difficulties associated with such prior art devices have been avoided.

What is claimed is:

1. A cover and valve assembly for covering the open top of a drinking receptacle, including:

(a) a plate having top and bottom surfaces;

(b) an annular rim surrounding said plate having a first point on said rim with a second diametrically opposite point, said plate having a beverage outlet opening adjacent to said first point;

(c) a valve head beneath said opening in said plate having resilient support means extending therefrom secured to the bottom surface of said plate biasing the valve head upwardly against the bottom periphery of said opening to normally close said opening; and, (d) an actuating member passing through a side opening in said rim beneath the undersurface of said plate, said member terminating in a camming surface engaging a portion of said valve head such that when said member is urged inwardly through said side opening in said rim it cams said valve head away from said opening to thereby open the same so that a person can drink a beverage from any receptacle over which said cover has been positioned.

2. An assembly according to claim 1, in which a bottom portion of said valve head includes an integrally formed resilient strip extending towards said second point of said rim beneath said plate and biased into a convex curved shape when viewed from the bottom, the extending end of said strip engaging said actuating member to bias it outwardly as a result of said strip tending to straighten.

3. The assembly of claim 1 wherein said support means comprise elongated arms extending from opposite sides of said valve head.

4. The assembly of claim 3 wherein said plate is inclined upwardly from the first point to said second point.

5. A drinking receptacle cover and valve assembly, including, in combination:

(a) a drinking receptacle having an open top;

(b) a cup shaped cover for closing off said open top of said receptacle including a lower annular wall portion dimensioned to surround the upper exterior portion of said open top and an upper annular wall portion of reduced diameter forming a rim and defining an internal downwardly facing annular step for seating on the periphery of said open top, an interior portion of said lower annular wall and exterior portion of said open top having integrally formed inter-engaging means for removably securing said cover to said receptacle, said cover further including a flat plate surrounded by and integrally formed with said rim, said rim having a first point and a second diametrically opposite point, said plate having an opening adjacent to said first point;

(c) a valve head positioned beneath the bottom surface of said plate and dimensioned to close said opening when moved upwardly against said bottom surface, said valve head having first and second integrally formed resilient arms extending therefrom and terminating at securement points to said bottom surface adjacent to either side of the second point of said rim such that said valve head is held against said bottom surface of said plate to close off said opening by said resilient arms, the underside of said valve head further including an integrally formed resilient strip extending in a direction below and in a plane between said first and second arms towards said second point of said rim to terminate in an attachment structure, said elongated strip being biased into a curved shape when viewed from the bottom; and, (d) a manually operable actuating member extending through said rim in a loose fit adjacent to said second point to pass beneath the bottom surface of said plate, the inner end of said member terminating in a camming surface, the underside of said valve head defining a cooperating camming surface such that inward movement of said member cams said valve head downwardly to flex portions of said first and second arms away from said bottom surface and open said opening, said attachment structure of said strip being coupled to said member to exert a bias force as a result of its tendency to straighten from its curved configuration to move said member outwardly so that said valve head can be closed against said opening by said flexible arms when said member is released, said strip also exerting a biasing force on said valve head to aid in closing the same whereby said receptacle can be filled with a hot or cold beverage and closed by said cover, and whereby a person can depress said actuating member inwardly to open said opening and thence drink, the elongated configuration of said opening conforming relatively closely to the person's mouth covering said rim at said first point and a portion of the top surface of said plate as the receptacle is tilted upwardly to drink, the loose fit of said member through said rim when depressed inwardly permitting air to enter said receptacle through said cover to replace the beverage passing out said opening.

6. An assembly according to claim 5, in which there are provided integrally formed guide blocks on the bottom side of said plate between which said actuating member passes for guiding inward and outward movement of said member.

7. An assembly according to claim 5, in which said inter-engaging means includes a plurality of lip segments circumferentially spaced about the bottom of said lower annular wall and extending radially inwardly short distances to define ledges, the exterior portion of said open top of said receptacle including a like plurality of circumferentially spaced radially outwardly extending ridges receivable between said lips such that when said cover is rotated through the circumferential extent of the lips, the ribs overlie said ledges to lock said cover to said receptacle, said ledges being sloped slightly to thereby cam the cover tightly onto said top opening when rotated.

8. An assembly according to claim 5, including a sealing gasket positioned on said downwardly facing annular step for seating on the periphery of said open top of said receptacle, and in which said actuating member includes a fixed collar at the point it emerges through said rim into the interior of said cover providing an engaging surface for said attachment structure at the end of said resilient strip; and a sealing washer between said collar and the inside wall portion of said rim through which said actuating member extends to seal off the area around the loose fit of said member through said rim when said member is in its outwardmost position.

9. An assembly according to claim 5, in which said valve head includes a lateral groove extending annularly about its edge; and a sealing gasket in said groove, the perimeter of the upper wall of said groove being less than the perimeter of said elongated opening and the perimeter of the lower wall of said groove and gasket being greater than the perimeter of said opening so that said upper wall is received within said opening with said gasket being sandwiched between the bottom periphery of said opening and said lower wall of said groove to thereby seal said opening when said actuating member is released.

10. An assembly according to claim 8 wherein said attachment structure comprises a fork-shaped end and said resilient arms extend from opposite side portions of said valve head.

* * * * *